US005267523A

United States Patent [19]

Hugron

[11] Patent Number: 5,267,523

[45] Date of Patent: Dec. 7, 1993

[54] RESILIENT SIGNALLING POST

[76] Inventor: Denis P. Hugron, 1855, Georges, St-Hubert, Quebec, Canada, J4T 1W2

[21] Appl. No.: 956,074

[22] Filed: Oct. 2, 1992

[51] Int. Cl.[5] ..... E01F 9/00

[52] U.S. Cl. ..... 116/63 R; 40/607; 404/10

[58] Field of Search ..... 116/63 R; 404/10; 40/608

[56] References Cited

U.S. PATENT DOCUMENTS

| | | | |
|---|---|---|---|
| 3,212,415 | 10/1965 | Byra | 404/10 |
| 4,061,435 | 12/1977 | Schmanski et al. | 40/608 |
| 4,084,914 | 4/1978 | Humphrey et al. | 4094/10 |
| 4,249,357 | 2/1981 | Cornou | 116/63 R X |
| 4,460,161 | 7/1984 | Grenga | 116/63 R X |
| 4,779,955 | 10/1988 | Schmanski | 116/63 R X |
| 5,040,478 | 8/1981 | Hughes | 40/608 X |
| 5,114,149 | 5/1992 | Bailey | 40/608 |

*Primary Examiner*—Daniel M. Yasich
*Attorney, Agent, or Firm*—Roland L. Morneau

[57] ABSTRACT

A signalling panel comprises two superposed transparent plies of plastic material peripherally secured together. The plates have a cylindro-convex configuration and the two plies are slightly spaced from each other to provide a slot therebetween for receiving a flexible sheet displaying a visible information through the two plies. The panel when narrow is secured to a rigid base while when wide is contemplated to be secured to a flexible base member.

11 Claims, 3 Drawing Sheets

RESILIENT SIGNALLING POST

BACKGROUND OF THE INVENTION

The present invention is directed to a signalling post of the self-uprighting type when hit by a vehicle and more specifically to a panel made of a flexible plastic which has a memory and which has a specific shape so as to bend and return to its original position and shape.

The shape of the panel is characterized by a two-ply panel having a convex cross-section and an inner spacing for receiving a sheet adapted to display a visual information through one of the faces of the two-ply panel.

The convex configuration of the panel is contemplated to provide a rigidity to a panel which has a relatively thin cross-section and which will allow the panel to return to its original shape after being hit sideways on its curved surface.

The panel is also provided with an inner slot for protecting a visual information when the panel is hit and for allowing the substitution of a plurality of different visual information.

Prior art

Self-uprighting posts are known. They usually rely on mechanical devices for returning the post to its upright position. In U.S. Pat. No. 4,806,046 issued on Feb. 21, 1989, Richard O. Clark relies on a coil spring and a cable located inside a pair of superposed cylindrical posts for providing the desired reaction of the post after it has been hit. Another type was disclosed by the present applicant in U.S. Pat. No. 5,090,348 issued on Feb. 25, 1992.

SUMMARY OF THE INVENTION

The signalling panel according to the invention is adapted to be upstandingly supported by a base member. It comprises two superposed transparent plies of plastic material peripherally secured together and which have a cylindrico-convex configuration. The two plies are slightly spaced from each other for providing a slot therebetween, the slot being adapted to receive a flexible sheet displaying a visible information through at least one of the plies.

The panel is contemplated in two differently identified versions. When the panel is narrow and elongated, it constitutes a post per se adapted to support a signboard. When the panel has wider dimensions, it is preferably adapted to be mounted on a base member which may be adapted to be anchored to a ground retaining foundation.

The flexible sheet adapted to be inserted in the slot between the two plies is contemplated, in one version, as a reflector, and in another version as a sheet displaying written or pictorial representation.

DETAILED DESCRIPTION OF THE INVENTION

Figures 1, 2, 3:
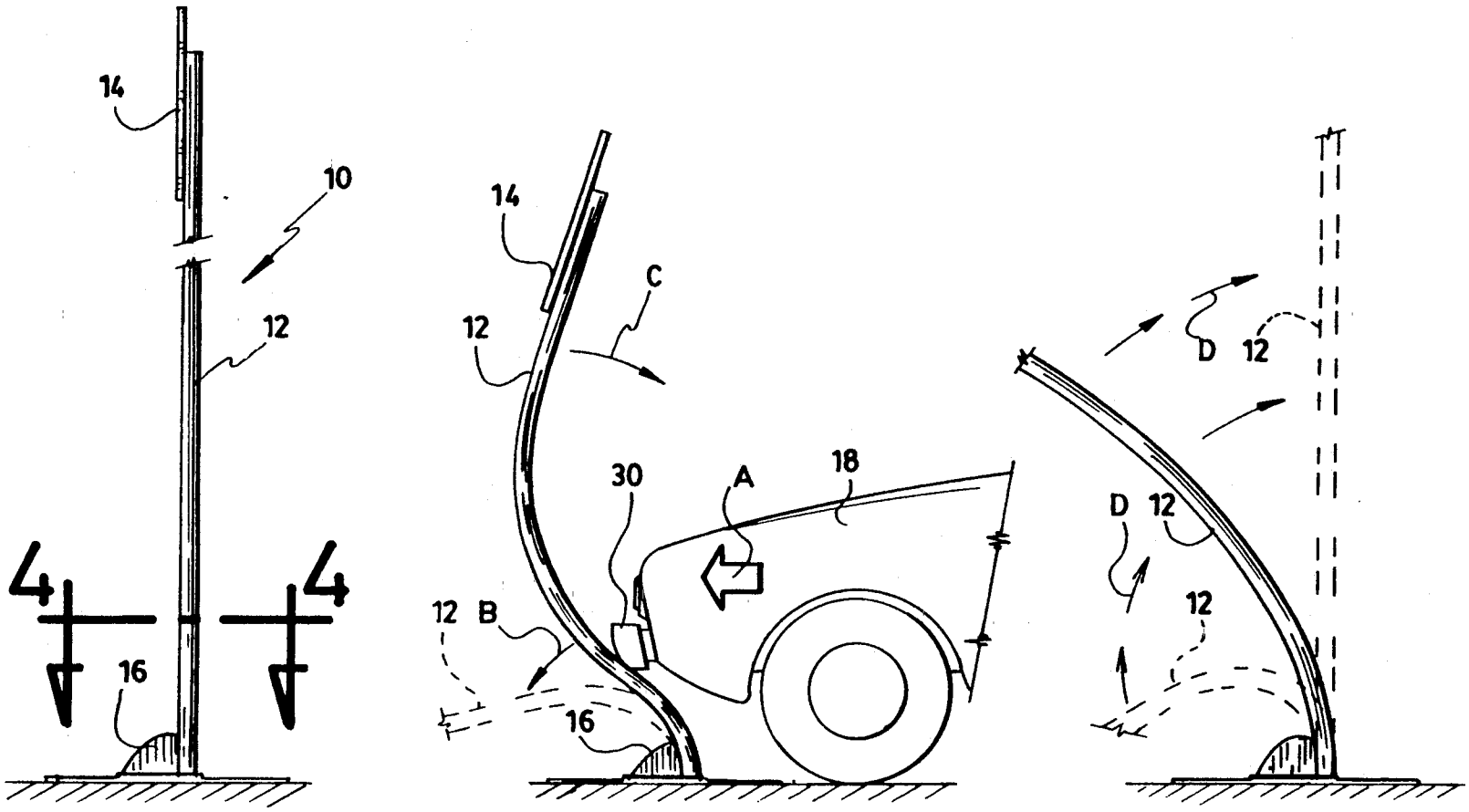
FIG. 1 is a side view of the panel according to the invention characterized by a post supporting a signboard.
FIG. 2 is a side view of the panel shown in FIG. 1 when being hit by a vehicle.
FIG. 3 is a side view of the panel shown in FIG. 2 when returning to its original upstanding position.
Figure 4:
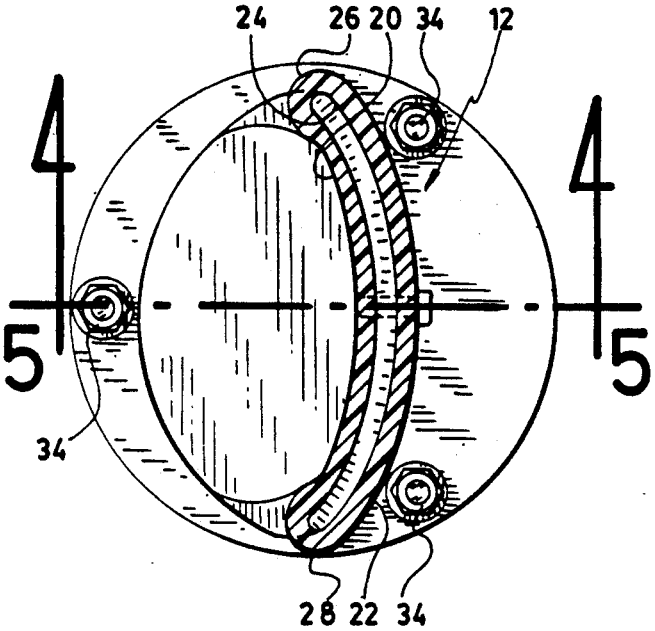
FIG. 4 is a cross-sectional view along line 4—4 of FIG. 1.

FIG. 1 illustrates a signalling post 10 which includes an embodiment of the new panel 12, a signboard 14 secured to the upper end of the panel 12, and a base member 16 for supporting the panel 12. The particularity of the present novel panel according to the invention is that it will resist breakage by flexing as shown in FIG. 2 when hit in the direction of the arrow A by a vehicule 18 so that its lower portion will flex in the direction of the arrow B and its upper portion will react by its inertia in the direction of the arrow C. However, when the vehicule is retracted, the characteristic of the novel panel 12 will be to return to its upright position in the direction of the arrows D.

In order to obtain such a result, the applicant has contemplated a panel which is made of two superposed cylindro-convex plates which are separated by a corresponding convex slot 24, both lateral ends 26 and 28 of the plates 20 and 22 being connected together. The panel may be made of a single sheet having an arc-shaped cross-section through which an air gap having a corresponding arc-shape extends. The contour of the panel 12 is preferably a rectangular segment of the surface of a cylindroid. The panel 12 is made of a flexible and resilient plastic which is provided with a memory to return to its original shape when bent as shown in FIG. 2.

The arc-shaped cross-section provides an additional resistance to bending when hit sideways by an object such as a vehicle because the panel will tend to flatten at about the location where it is hit, that is, by the bumper 30. The first reaction of the panel 12 after the striking implement is removed, is to return to its arc-shaped cross-section and the arc-shaped configuration forces the panel 12 to return to its upstanding position as shown by arrows D in FIG. 3.

As stated above, the material used is a plastic which has a memory and adapted to return to its original shape. A plastic such as polycarbonate provides satisfactory results as far as bending and unbending is concerned. This plastic is also suitable to stand a large range of temperatures when exposed to the weather conditions.

The air gap between the two superposed plates 20 and 22 forms a slot which extends from one end 26 to the other end 28 of the panel 12. The slot is intended to receive a sheet or film dislaying a visual signal. Such a signal may be a mere reflector which can pick up the light from headlights of cars or may carry a readable message for signalling or warning drivers or passerbys. The advantage of an internal slot between the two plates 20 and 22 which are closed at both ends, is that they constitute a protective housing for the sheet or film which will not be destroyed or damaged when the panel 12 is hit by a striking implement or a vehicle as shown in FIG. 2. Another advantage of such a housing is at the sheet or film or any visible signal may be substituted when required.

The panel 12 is supported by a base member 16 which may rest on the ground or be held to a ground retaining member (explained in FIG. 8) by a set of bolts 34. The upper part of the base member 16 extends upwardly into a flat curved lip 36 adapted to project inside the convex slot 24. The panel 12 is secured to base member 16 by a pair of bolts 38 extending through holes 40 provided adjacent the lower part of the panel 12 and through the curved lip 36 of the panel.

With this arrangement, the base member 16 is held parallel to the ground and the lip 36 extends upwardly at a height which is sufficiently low as to clear the undercarriage of normal vehicles. Accordingly, only the panel 12 will be deflected as shown in FIG. 2 and as previously explained, will return to its original upstanding position. The base member 16 may be secured to a board 72 as explained in detail later.

Figure 7:
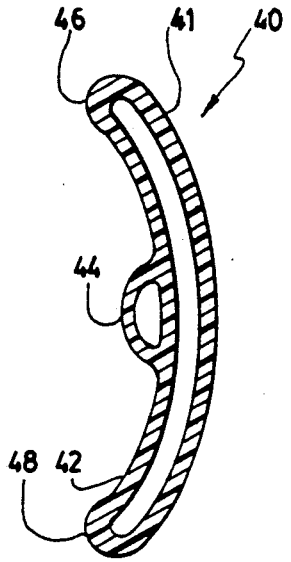
FIG. 7 is a cross-sectional view of an alternative embodiment of a signalling panel.
Figure 5:
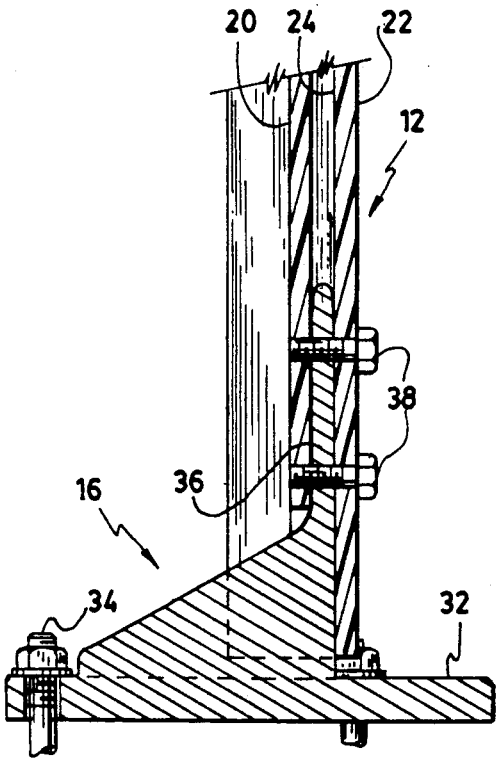
FIG. 5 is a cross-sectional view along line 5—5 of FIG. 4 showing the panel and its supporting base member.
Figure 6:
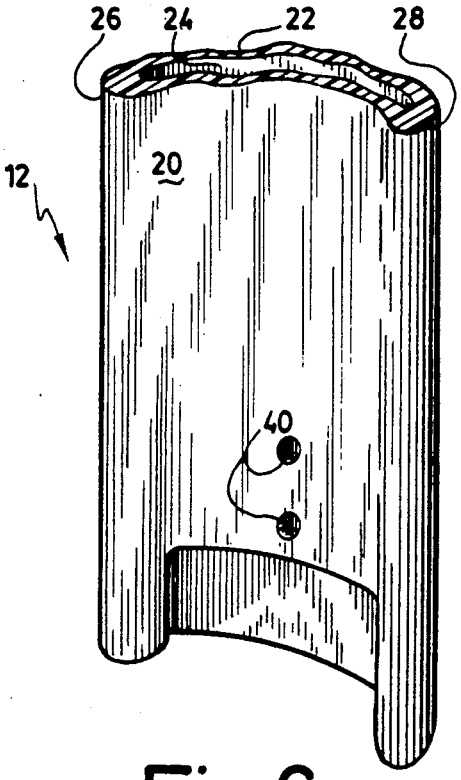
FIG. 6 is a perspective view of the lower portion of the panel shown in FIG. 1.

A different embodiment of the panel 12 is illustrated in FIG. 7 wherein a substantially similar cross-sectional shape is maintained. However, the rear plate 42 of the panel 40 is provided with vertical reinforcing ribs along the lateral peripheral edges 46 and 48 for increasing the vertical rigidity to the panel 40. With such lateral ribs, the panel per se can be provided with thinner front and rear plates 41 and 42 which is partly intended to reduce the cost of the panel. Additional ribs such as 44 are also contemplated on the rear plate 42 between both edges 46 and 48. Such additional ribs are added when a relatively stiff panel is needed while providing all the bending functions specified above.

The panels as illustrated in FIGS. 1–7 constitute a supporting post in itself for a signboard 14 and as such is intended to have a rather narrow width of about 3 to 6 inches.

Figure 10:
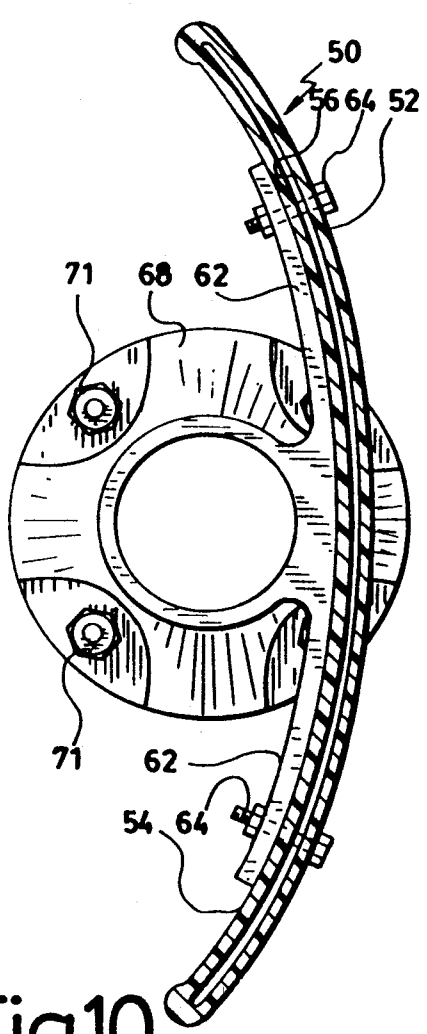
FIG. 10 is a cross-sectional view taken along line 10—10 of FIG. 8.
Figure 9:
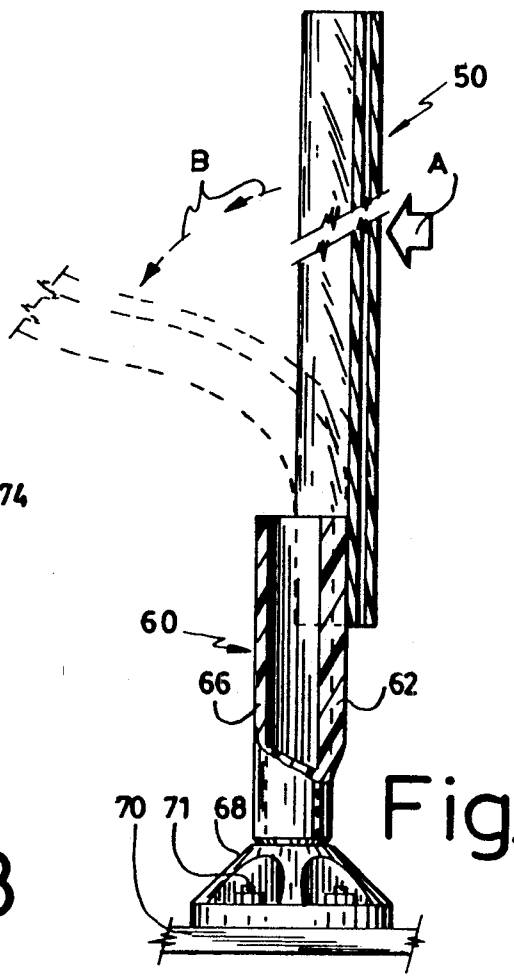
FIG. 9 is a cross-sectional view taken along line 9—9 of FIG. 8.
Figure 8:
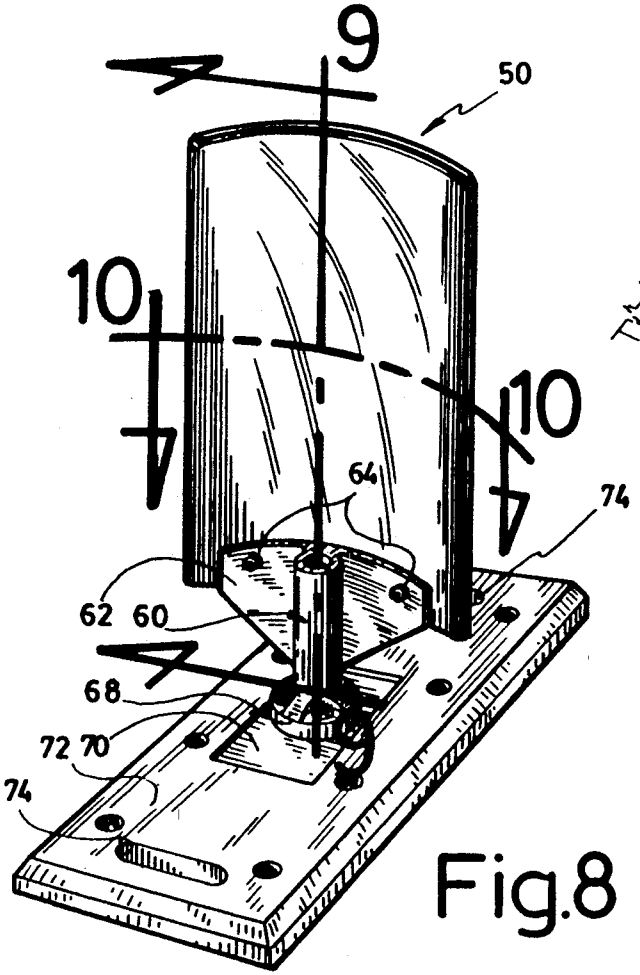
FIG. 8 is a perspective view of a different embodiment of a signalling panel supported by a base member.

FIGS.8–10 illustrate another embodiment of the invention wherein the panel 50 constitutes the signboard per se. Under such condition, the panel 50 has a width which extends from 1 to 4 feet and has a height of about 3 to 10 feet. The panel 50 has a cross-section corresponding to the embodiments illustrated in FIGS. 4, 6 and 7 and is adapted to bend substantially as illustrated in FIGS. 2 and 3. It is made of a front cylindro-convex plate 52 and a corresponding rear plate 54 rearwardly positioned in a spaced relationship with the plate 52 so as to leave a gap 56 therebetween for the introduction of a visible illustration and usually a readable text.

Considering that the area covered by a large panel such as 50 provides a greater resistance particularly adjacent its base when hit by a vehicle, the lower part of the panel 50 is preferably secured to an uprighting post 60 welded to a matching curved connecting plate 62. The plate 62 is fixed to the panel 50 by a set of bolts and nuts 64. The uprighting post 60 which is contemplated for the present invention is of the type described in U.S. Pat. No. 4,806,046 issued on Feb. 21, 1989. Such an uprighting post will allow a flexibility adjacent at a ground and a stronger resistance to breakage when the panel 50 is hit in the direction of arrow A. Under such an impact, the panel 50 is flexed in the direction of the arrows B and the upper portion 66 of the uprighting post 60 will flex relative to the base member 68 as foreseen in the above identified United States patent. The base member 68 is secured to a ground retaining foundation or to a rigid plate 70 by a set a set of bolts and screws 71. The base member 68 may be mounted on a quick connect plate 70 as disclosed in a co-pending application filed by the same applicant. The same quick connect plate 70 is mounted on a heavy board 72 having a pair of handles 74 located at both ends of the board 70. In operation, the board 72 is disconnected from the post 60 through the quick connect plate 70 whenever the panel 50 needs to be transported or stored with the board 72 considering that a vertical panel 50 connected to a horizontal board such as 72 requires more storage space then when the panel is disconnected from the board 72.

The board 72 is preferably made of a thick rubber mat light enough to be hand loaded in a truck but sufficiently heavy to be displaced only a short distance when the panel 50 is hit. It has been found that a board 72 weighing about 30 pounds and having a low friction coefficient such as rubber provides satisfactory results as a ground retaining member. The base member 16 can also be suitably connected to a board such as 72 through a quick connect plate 70.

I claim:

1. A signalling post comprising a panel made of flexible plastic material, said panel being vertically elongated and having an arc-shaped horizontal cross-section, said panel being made of two superposed cylindro-convex plates separated by a distance defining a convex slot, said plates being secured to each other along their lateral peripheral edges, a base member for supporting said panel, said base member arranged to be anchored to a ground retaining member, whereby said panel, upon an impact by a vehicle across one of said plates will bend downwardly and a portion of its arc-shaped cross-section will flatten, said panel will subsequently return to its vertically elongated position and its arc-shaped cross-section after said impact.

2. A signalling post as recited in claim 1, wherein said panel has a contour defining a rectangular segment of a cylindroid.

3. A signalling post as recited in claim 2, wherein said panel has a vertical reinforcing rib projecting from the panel on the side said convex surface.

4. A signalling post as recited in claim 2, wherein said base member comprises a stiff connecting plate secured to the lower edge of said panel and means for self-uprighting said connecting plate when hit sidewardly.

5. A signalling post as recited in claim 2, wherein the panel is made of polycarbonate.

6. A signalling post as recited in claim 5, wherein the slot defines a spacing of about ⅛ inch.

7. A signalling post comprising a supporting base member and a upstanding transparent panel supported by said base member and extending upwardly therefrom, said panel having a horizontal convex cross-section and a vertical slot inside said panel defining a convex cross-section, said slot defining a protective housing for receiving a visible and flexible poster, said panel being made of resilient plastic whereby said panel will return to its original shape after being hit on its convex surface and will protect said poster.

8. A signalling post as recited in claim 7, wherein said panel has a width of about three to six inches.

9. A signalling post as recited in claim 8, wherein said panel is made of polycarbonate.

10. A signalling post adapted to be upstandingly supported by a base member, said panel comprising two superposed transparent plies of flexible and resilient plastic material peripherally secured together, said plies having a cylindro-convex configuration and being slightly spaced from each other for providing a slot therebetween, said slot being arranged to receive a flexible sheet displaying a visible information through at least one of said plies, whereby said panel will return to its original configuration after being hit on its convex surface and said plies will protect said flexible sheet.

11. A signalling post comprising a panel made of flexible plastic material, said panel being vertically elongated and having an arc-shaped horizontal cross-section, said panel being made of two superposed cylindro-convex plates separated by a distance defining a convex slot, said plate being secured to each other along their lateral peripheral edges, a base member for supporting said panel, said base member arranged to be anchored to a ground retaining member, said panel being provided with a slot inside said panel and having a convex cross-section substantially similar to the cross-section of the panel, a visible and flexible poster located inside said slot, said panel being made of resilient plastic, whereby said panel will return to its original shape after being hit on its convex surface and will protect said poster.

* * * * *